US006622947B1

(12) United States Patent
Rivera

(10) Patent No.: US 6,622,947 B1
(45) Date of Patent: Sep. 23, 2003

(54) RAIN SHOWER HEAD DEVICE

(76) Inventor: Joseph Rivera, HC 38 Box 123, Las Vegas, NV (US) 89124

( * ) Notice: Subject to any disclaimer, the term of this patent is extended or adjusted under 35 U.S.C. 154(b) by 0 days.

(21) Appl. No.: 10/348,527

(22) Filed: Jan. 20, 2003

(51) Int. Cl.[7] ..... B05B 1/20; A62C 31/02; A62C 31/00

(52) U.S. Cl. ..... 239/566; 239/391; 239/437; 239/438; 4/601

(58) Field of Search ..... 239/566, 391, 239/437, 438, 392, 390, 436, 439, 440, 273, 282, 575; 4/601, 605, 615

(56) References Cited

U.S. PATENT DOCUMENTS

| | | | | |
|---|---|---|---|---|
| 595,069 | A | 12/1897 | Nisbet | 239/548 |
| 759,874 | A | 5/1904 | Fletcher | 4/618 |
| 1,406,070 | A | 2/1922 | Patton | 4/567 |
| 1,893,435 | A | 1/1933 | Neal | 4/615 |
| 2,017,396 | A | 10/1935 | Brown | 4/615 |
| 2,060,100 | A | 11/1936 | Michelson | 239/110 |
| 3,724,760 | A | 4/1973 | Smith | 239/282 |
| 3,858,252 | A | 1/1975 | Ejchorszt | 4/145 |
| 4,545,083 | A | 10/1985 | Searson | 4/615 |
| 4,749,130 | A | 6/1988 | Utzinger | 239/543 |
| 4,809,369 | A | 3/1989 | Bowden | 4/615 |
| 5,409,167 | A | 4/1995 | Borod | 239/152 |
| 5,909,969 | A | 6/1999 | Davison | 4/569 |

*Primary Examiner*—Michael Mar
*Assistant Examiner*—Darren Gorman
(74) *Attorney, Agent, or Firm*—Michael I. Kroll

(57) ABSTRACT

The present invention 10 discloses a shower head having a tubular shaped housing 12 which extends from the shower water outlet spout 30 over a large portion of the tub. A plurality of water ports 22 are provided between the two distal ends of a tubular housing 12 for dispensing the water spray 14. To maximize the water spray area, each of the water ports 22 is covered with an aerator screen 24 which disperses the water into a stream of droplets simulating a rain shower. In a preferred embodiment of the present invention 10, the tubular shaped housing includes shower ports 36 of various sizes on a slidable inner tubular member 32 providing the user the ability to control the volume of the water dispersed. A positioning member 34 controlled by the user 15 is moved laterally within the tubular housing to cover portions of the apertures 22 so that the volume of water dispersed is thus controlled by the position of the positioning member 34.

2 Claims, 9 Drawing Sheets

RAIN SHOWER HEAD DEVICE

BACKGROUND OF THE INVENTION

1. Field of the Invention

The present invention relates generally to a bathing spray apparatus and, more specifically, to a water spray apparatus whereby the method for delivering the water spray simulates a rain shower.

There are various styles of shower heads, both regular and pulsating that are normally connected at the shower port on the wall of the tub above the water faucets. Most all of which dispense water spray that is angled toward the bather providing water to only a portion of the body at one given time. Other various styles of shower heads include extensions that enable the bather to hold the shower head and better direct the water spray, but such devices can become inconvenient for the user and limits the user to cleanse with one hand. This can be particularly difficult while shampooing one's hair.

The present invention overcomes the shortcomings of prior art by providing the user a means to dispense water spray over an entire body area and without need of the holding the shower head by hand.

Simulating a rain shower, the present invention douses the entire body of the user with water spray providing better means to cleanse the body, including hard to reach locations and washing of the hair.

The present invention simulates a rain shower by extending a tubular shaped housing from the shower water port over a large portion of the tub. More particularly, the open distal end the tubular shaped housing is connected to the shower water port at the wall and extends horizontally outward into the tub and over the user to a closed portion at the other distal end of the tubular shaped housing.

A plurality of water ports are provided between the two distal ends for dispensing the water spray. To maximize the water spray area, each of the water ports is covered with an aerator screen. The aerator screens disperse the water into a stream of droplets simulating a rain shower.

This improvement shower structure may be used as a replacement for a conventional shower head or installed initially as an integral portion of the bathroom. In either installation, the open distal end of the tubular shaped housing includes an industry standard size threaded connector that is connected to the shower water port that extends from the wall.

In a preferred embodiment of the present invention, the tubular shaped housing includes shower ports of various sizes providing the user the ability to control the volume of the water dispersed. With this embodiment, a positioning member controlled by the user is moved laterally forcing a sealing element within the tubular housing to cover portions of the apertures. The volume of water dispersed is thus controlled by the position of the positioning member.

2. Description of the Prior Art

There are other water spray apparatus. Typical of these is U.S. Pat. No. 595,069 issued to H. D. Nisbet on Dec. 7, 1897.

A patent was issued on May 17, 1904 as U. S. Pat. No. 759,874 to O. C. Fletcher. Another patent was issued to L. R. Patton on Feb. 7, 1922 as U.S. Pat. No. 1,406,070. Yet another U.S. Pat. No. 1,893,435 was issued to T. E. Neal on Apr. 10, 1931 and still yet another was issued on Feb. 7, 1935 to P. Brown as U.S. Pat. No. 2,017,396.

U.S. Pat. No. 2,060,100 was issued to B. S. Michelson on Feb. 28, 1935. Another patent was issued to Earl W. Smith on Apr. 3, 1973 as U.S. Pat. No. 3,724,760. Yet another U.S. Pat. No. 3,858,252 was issued to Olgierd Z. Ejchorszt on Jan. 7, 1975 and still yet another was issued to Thomas E. Searson on Oct. 8, 1985 as U.S. Pat. No. 4,545,083.

Another patent was issued to Gustav E. Utzinger on Jun. 7, 1988 as U.S. Pat. No. 4,749,130. U.S. Pat. No. 4,809,369 was issued on Mar. 7, 1989 to John H. Bowden and on May 22, 1990 N. Charles Daunt was issued U.S. Pat. No. 4,927,083. Murray Borod was issued U.S. Pat. No. 5,409,167 on Apr. 25, 1995. Another patent was issued to Donald R. Davison on Jun. 8, 1999 as U.S. Pat. No. 5,909,969.

This invention relates to improvements in needle baths, and it consists in the novel arrangement and combination of parts. The object of this invention is to construct a needle bath whereby a spray of water will be delivered to the bather in such a manner as to cause spray to circumscribe a maximum superficial area of the body of the person and to construct said device as to operate upon every portion of the area so circumscribed.

This invention relates to improvements in shower bath hose, and it consists in so forming the hose that the openings through which the several jets or streams of water flow are held away from the neck or portion of the body to which the hose is applied.

This invention relates to a shower attachment for bath tubs and an object of the invention is to provide a device applicable for attachment to bath tubs of existing types which will permit the engagement of an efficient overhead shower bath.

This invention relates to shower bath and more particularly to spray apparatus. At the present time shower bath sprays are so constructed that the shower bath cannot be taken without the water striking a person's head causing the hair to become wet. This is often objectionable and therefore one object of this invention is to provide a spray so constructed that while water may strike the shoulders and other portions of the person's body, it will be prevented from striking a person's head and causing the hair to become wet.

This invention relates to a shower bath attachment particularly designed so that the same may be used in conjunction with an ordinary bathtub. The prime object of this invention resides in the provision of an attachment which may be easily mounted in place or dismounted and which is adjustable as to height.

This invention relates to shower bath attachments, and more particularly to attachments for converting an ordinary bathtub into a shower. The chief object of the invention is to provide a new and improved attachment of the above described character that shall be simple in construction and cheap to manufacture, that shall be adapted to become readily attached to, and as readily detached from, the ordinary faucet of the bath tub or the like; and that shall not interfere with the normal flow of water through the faucet for normal purposes.

A water distributing device for use in a shower, bath or the like in which a vertical pipe with spray apertures is surrounded by movable, water-tight sleeve having predetermined cut out areas which will provide for turning on and off the spray as a function of relative vertical height by rotating the sleeve a predetermined angular distance.

An improvement shower structure that may be used as a replacement for a conventional shower head or installed initially as an integral portion of the bathroom. The shower structure permits the user to selectively direct a uniform spray of water over a desired portion of the body, and is particularly adapted for the use of woman or elderly persons who may now take a shower without getting their hair and head wet. Also, the shower structure is adapted for being formed as an integral part of a wall structure to direct a spray of water over the trunk portions of a user.

Water for bathing is sprayed from a hollow plate having a series of internal channels and a corresponding series of rows of openings from the channels through one face of the plate.

A shower system comprising an elongated tubular conduit having several windings arranged in helix formation with a central helix axis disposed vertically is used by persons to shower. Perforations having an outlet size of about 0.8 mm.sup.2 are located in the inner sidewalls of the windings which sides face toward the central helix axis. A length of the spraying extends over a length of about 10 to 20 meters so that the internal helix space houses a person standing or sitting therein. The temperature of the water ejected from the perforations can be raised so high and can be sustained for so long that the person taking such a shower undergoes a sauna effect. This sauna effect is provided by a distance between adjacent perforations, in the spraying zone, of about 2.5 to 10 centimeters (or 200 to 400 over the entire spraying zone).

A portable body shower includes a plurality of tubular sections which can be connected to form a pipe with a closed bottom end and a hollow center. The top end of the pipe can be connected to any standard shower extension. The pipe extends downward and has perforations for supplying water in a horizontal direction toward a person showering. The device also includes non-perforated tubular sections so that water is directed at selected areas of a person's body adjacent the perforated sections. A tubular section is also provided for dispensing soap. The body shower includes a swivel joint to enable the pipe to be rotated to direct water in any direction. The tubular sections are made of a plastic material such as polyvinyl chloride.

An improved shower head comprising a length of hollow tubing in the shape of a vertically disposed loop having spaced apart, vertically supported side sections and a horizontally supported bottom section joining respective lower ends of the side sections in which a preferred embodiment of the loop is annular in shape to include a horizontally supported top portion joining respective upper ends of the side sections, the outer wall portions of the tubing forming the outer face of the loop facing the bather containing spaced apart orifices producing a vertically disposed spray pattern. The orifices are located along the tubing wall region of the interior portion of the loop outer face an offset distance from the center line of the outer tubing wall that forms the face of the loop generating a spray pattern having an inwardly directed component around the periphery of the loop or annulus. The improvement relates to a variation in the angular location of the orifices with respect to the tubing wall region interiorally of the loop outer face and central axis of the tubing in different sectors of the bottom section of the annular loop and a variation in the spacing between adjacent orifices along the bottom section establishing a larger upperwardly directed angle of spray and a greater volume of spray in the central portion of the bottom section of the loop, thereby providing superior cleansing action on the lower trunk portion of the bather's body.

A hygienic spray bottle dispenses liquid through a discharge tube. The spray bottle includes an electrically powered pump for pressurizing the liquid; a discharge tube having a nozzle; a valve for dispensing the pressurized liquid; and a pickup tube extending to the bottom of the bottle. A rechargeable battery powers the pump. The discharge tube is configured to cooperate with a toilet bowl wall to allow the spray bottle to function as a portable bidet. The discharge tube has a sliding sleeve for selectively covering and uncovering liquid spray holes to vary the spray pattern or location. Alternatively, the discharge tube includes a flexible section to vary the orientation of the nozzle for douching. The hygienic spray bottle is capable of being used in the absence of an external plumbing system.

A full body shower system having three generally horizontal water dispensing portions or portions and two generally vertical closed portions or portions connecting the horizontal portions or portions. The maximum number of water spray apertures in the system is sixty. The apertures are located in the horizontal water dispensing portions or portions at angles with respect to the horizontal to direct water in a predetermined pattern.

While these bathing and showering devices may be suitable for the purposes for which they were designed, they would not be as suitable for the purposes of the present invention, as hereinafter described.

SUMMARY OF THE PRESENT INVENTION

The present invention discloses a shower head having a tubular shaped housing which extends from the shower water spout over a large portion of the tub. A plurality of water ports are provided between the two distal ends of a tubular housing for dispensing the water spray. To maximize the water spray area, each of the water ports is covered with an aerator screen which disperses the water into a stream of droplets simulating a rain shower. In a preferred embodiment of the present invention, the tubular shaped housing includes shower ports of various sizes on a slidable inner tubular member providing the user the ability to control the volume of the water dispersed. A positioning member controlled by the user is moved laterally within the tubular housing to cover portions of the apertures. The volume of water dispersed is thus controlled by the position of the positioning member.

A primary object of the present invention is to provide a bathing spray apparatus that simulates a rain shower.

Another object of the present invention is to provide a bathing spray apparatus that dispenses water from a horizontally disposed pipe.

Still another object of the present invention is to provide a bathing spray apparatus that dispenses water over the entire body.

Yet another object of the present invention is to provide a bathing spray apparatus that affords improved means to cleanse one's body.

Still another object of the present invention is to provide the user means to control the water flow volume of a bathing spray apparatus.

Another object of the present invention is to provide a bathing spray apparatus that includes a series aerated screened apertures for water dispersal.

Yet another object of the present invention is to provide a bathing spray apparatus that is economical to manufacture.

Additional objects of the present invention will appear as the description proceeds.

The present invention overcomes the shortcomings of the prior art by providing a simulated rain shower by dispensing water from a horizontally disposed pipe and providing the user a means to dispense water spray over an entire body area and without the need of holding the shower head by hand.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
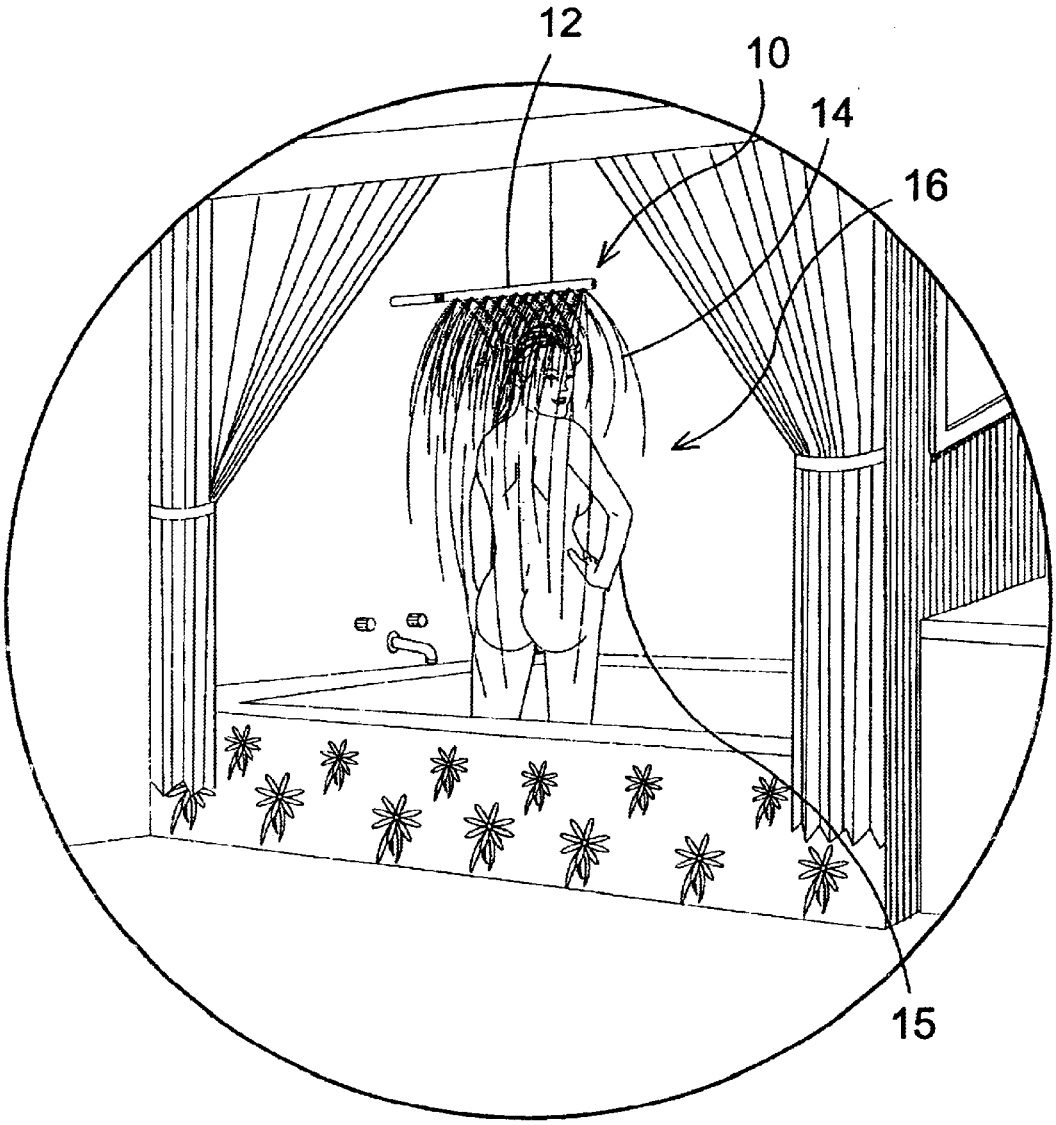
FIG. 1 is an illustrative view of the present invention.

With regard to reference numerals used, the following numbering is used throughout the drawings.

10 present invention
12 tubular housing
14 water
15 user
16 shower
18 connector
20 closed end
22 water outlet port
24 aerator screen
26 threads of connector
28 threads of spout
30 outlet spout
32 inner adjustment tube
34 positioning member
36 outlet port of inner tube
38 slot

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 for use in a shower 16. The shower head of the present invention 10 is an adaptable device that can be installed in place of a conventional type shower head. The tubular shaped housing 12 consists of a threaded portion at one distal end for installation to the existing plumbing. A plurality of spaced apart water ports have aerator screens to disperse the water 14 transversely. The design provides the user 15 a shower that covers both front and back of the body simultaneously.

Figure 2:
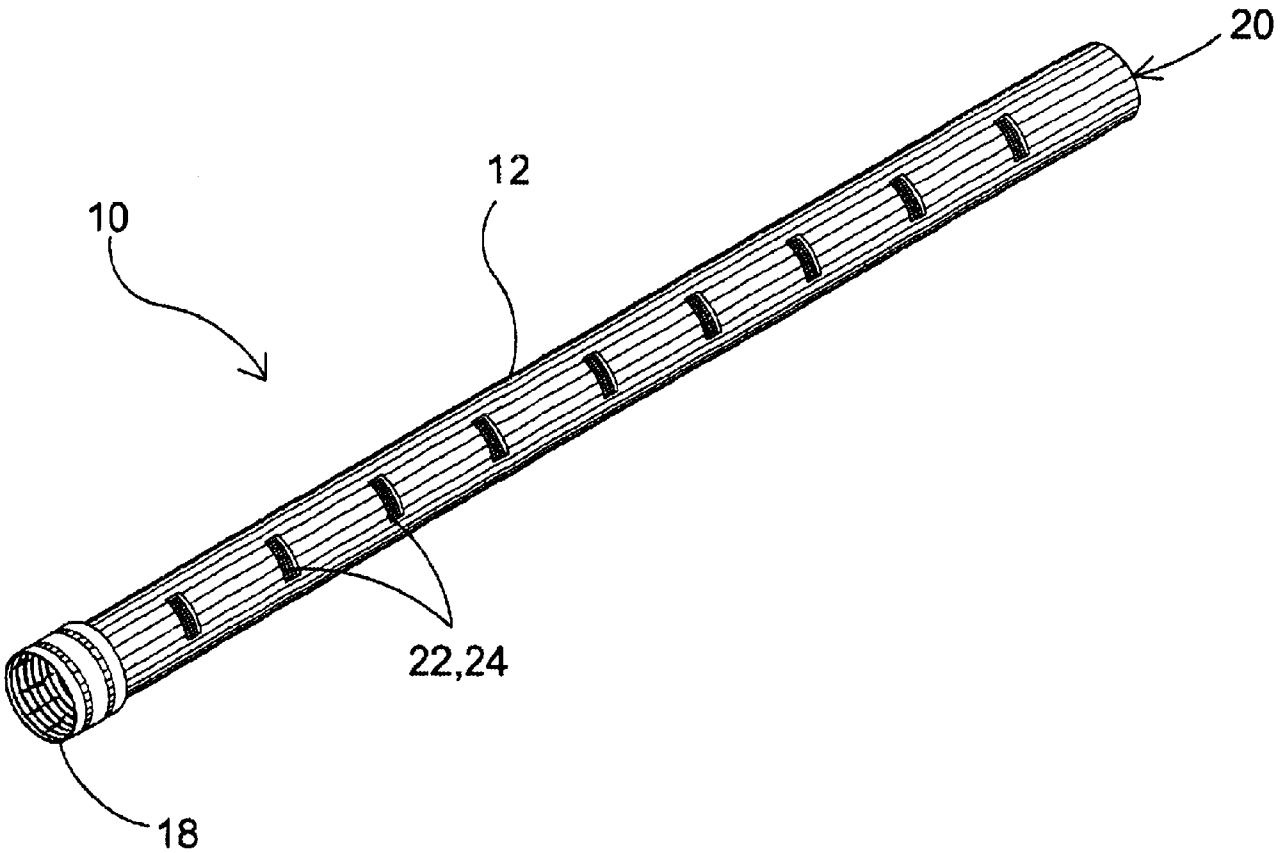
FIG. 2 is a bottom perspective view of the present invention.

Turning to FIG. 2, shown therein is a bottom perspective view of the present invention 10. Shown is the shower head of the present invention 10 having a tubular housing 12 with a threaded connector 18 at one distal end and a closed portion at the other distal end 20. Water outlet ports 22 are provided with aerator screens 24. The device 10 can be used in place of a conventional type shower head.

Figure 3:
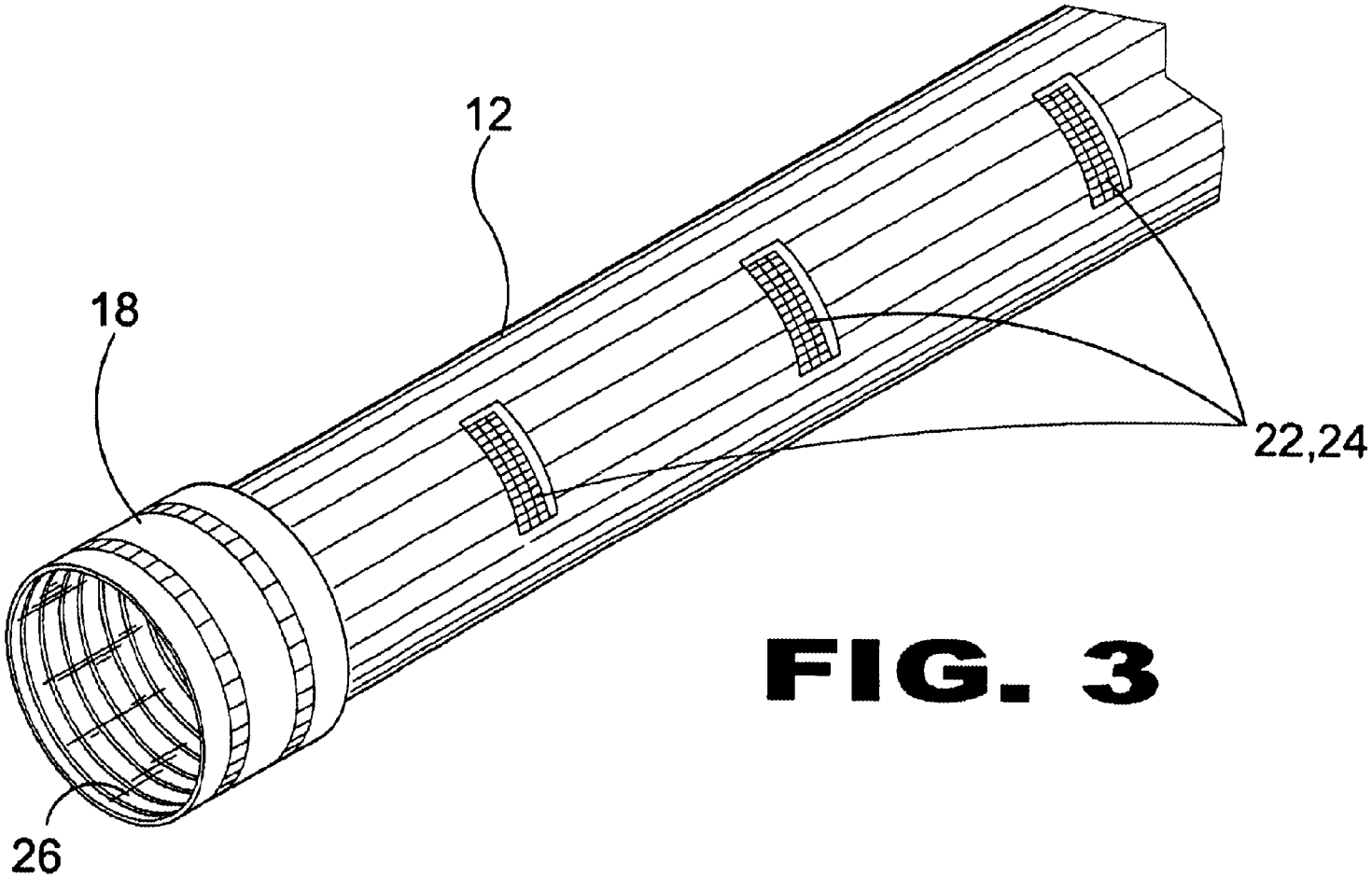
FIG. 3 is an enlarged view of the aerated water ports.

Turning to FIG. 3, shown therein is a n enlarged view of the aerated water ports 22. Shown i s a n enlarged view of the water port 22 being substantially a slot for dispensing the water transversally to the shower head 12 with a screen 24 disposed therein for disbursing the water over a larger area. Also shown is the connector 18 having conventional threads for attachment to the existing plumbing.

Figure 4:
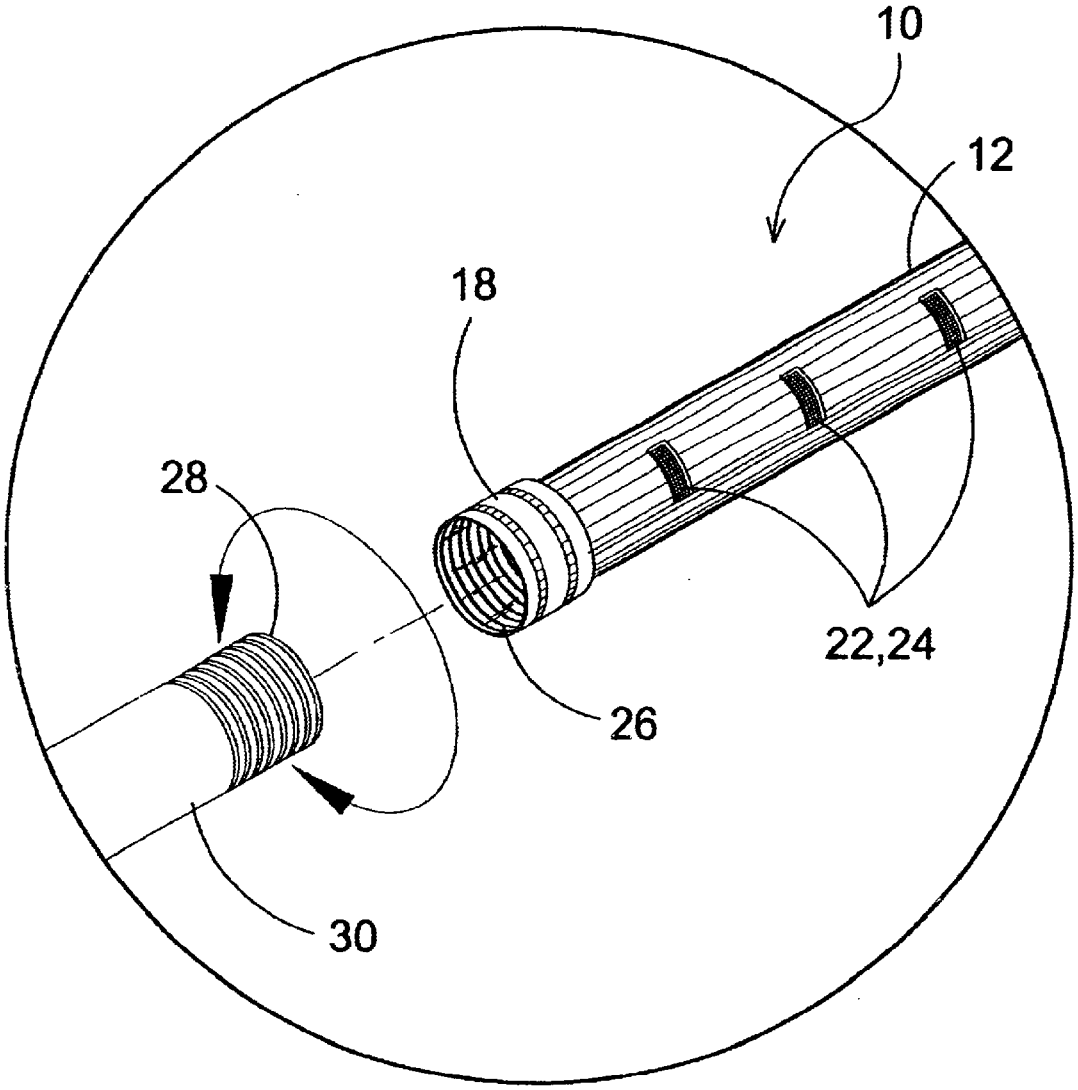
FIG. 4 is a detailed view of the present invention.

Turning to FIG. 4, shown therein is a detailed view of the present invention 10. Shown is the shower head of the present invention 10 having a long tubular housing 12 with a threaded connector 18, 26 at one distal end and a closed portion at the other distal end. Water outlet ports 22 are provided with aerator screens 24. The device can be adapted to the threaded spout portion 28 of an existing straight shower water outlet spout 30 in place of a conventional type of shower head.

Figure 5:
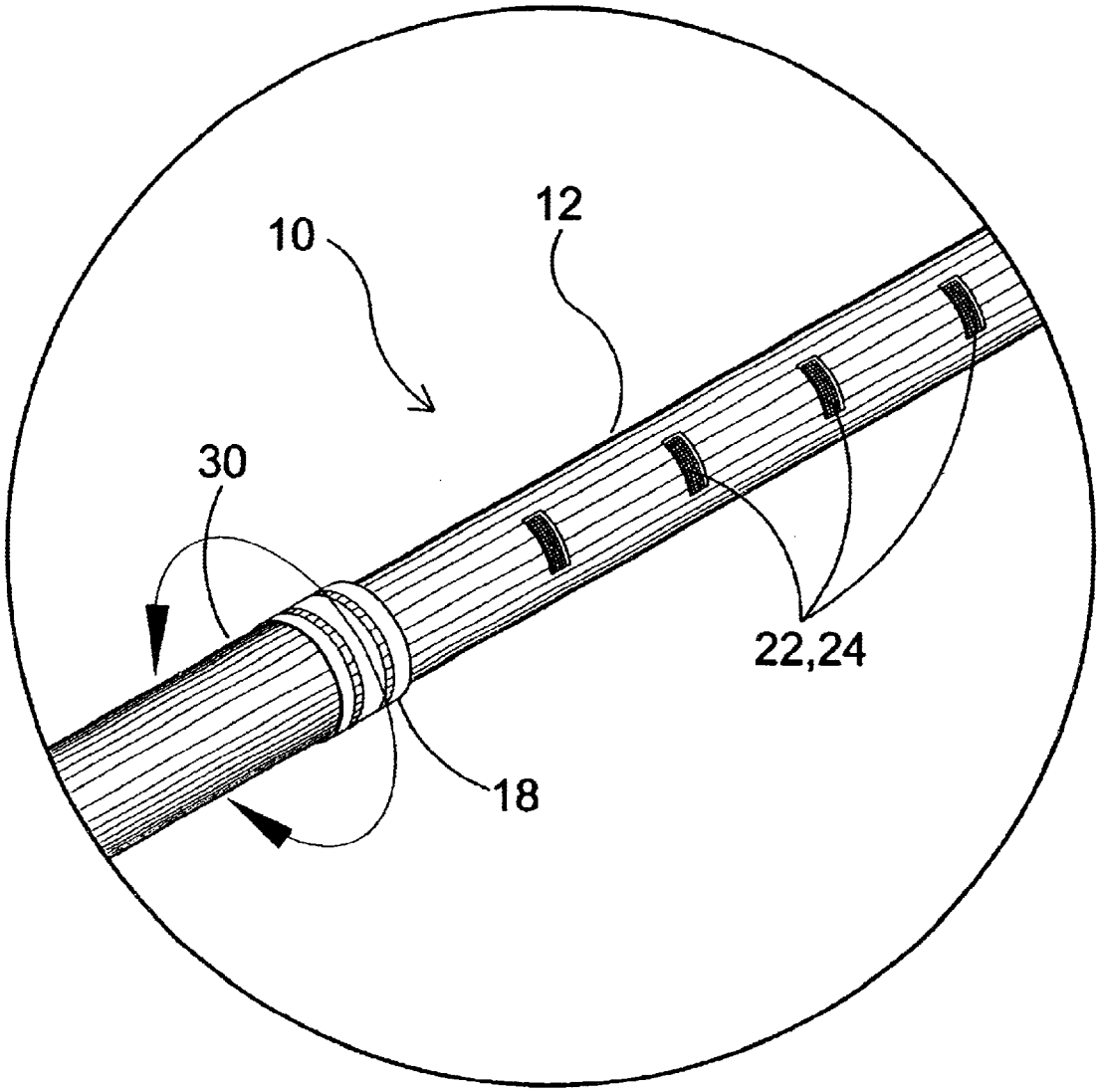
FIG. 5 is a detailed view of the present invention.

Turning to FIG. 5, shown therein is a detailed view of the present invention 10. Shown is the shower head of the present invention 10 having a long tubular housing 12 with a threaded connector 18 adapted to the threaded portion of a water outlet 30 in place of a conventional shower head. The water outlet ports 22 and aerator screens 24 are also shown.

Figure 6:
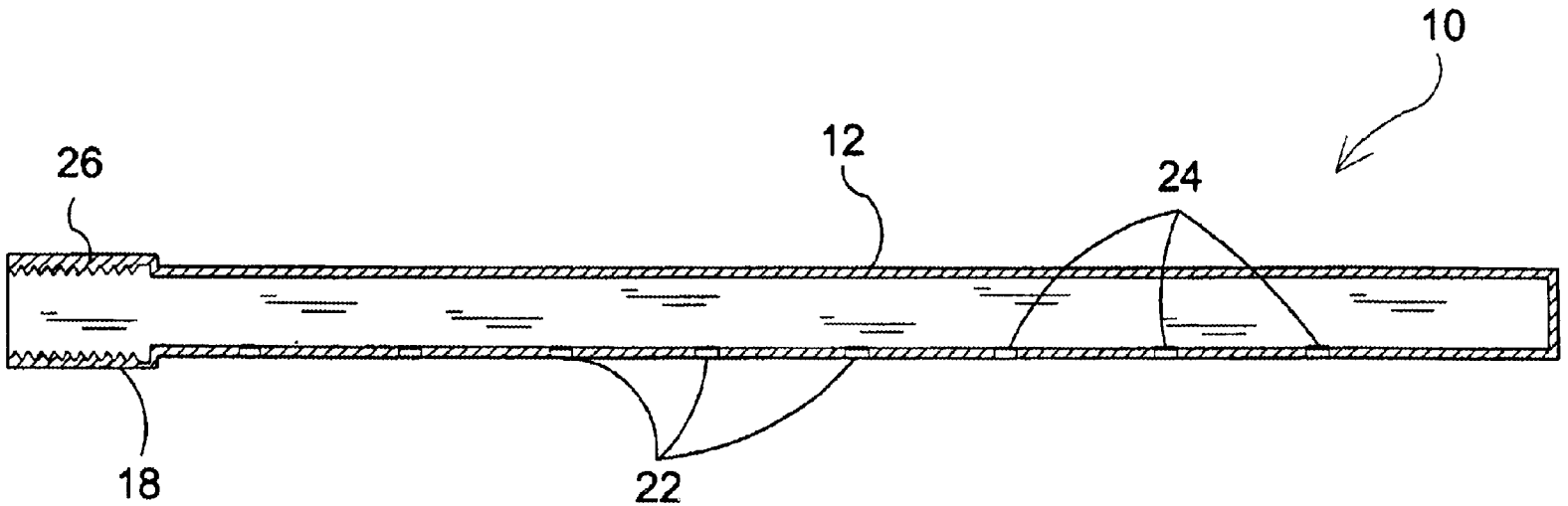
FIG. 6 is a sectional view of the present invention.

Turning to FIG. 6, shown therein is a sectional view of the present invention 10. The shower head of the present invention 10 is a tubular housing 12 that can be installed in place of a conventional type shower head. The tubular shaped housing 12 consists of a threaded portion 26 of a connector 18 at one distal end for installation to the existing plumbing. The shower head 12 has a plurality of water ports 22 having aerator screens 24 and a closed other distal end. The design allows the user a shower that covers both front and back of the body simultaneously.

Figure 7:
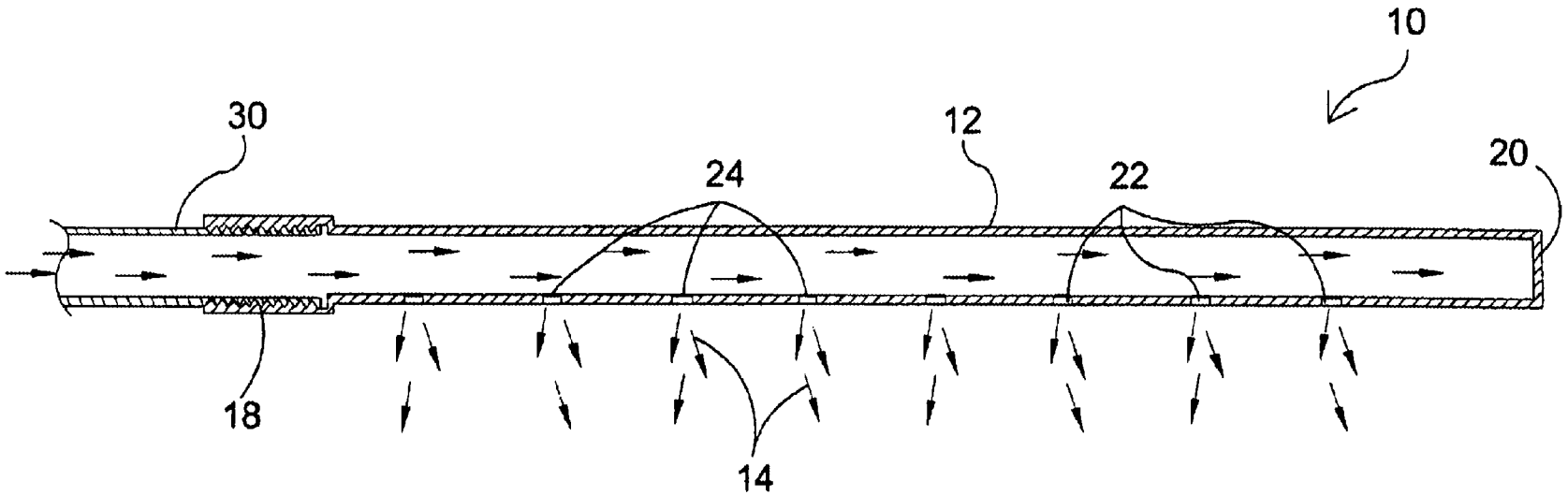
FIG. 7 is a sectional view of the present invention.

Turning to FIG. 7, shown therein is a sectional view of the present invention 10. The tubular shower head 12 of the present invention 10 is an adaptable device that can be installed in place of a conventional type shower head. The tubular shaped housing 12 consists of a threaded portion 18 at one distal end for adapting to its counter part 30, water ports 22 having aerator screens 24 and a closed second distal end 20. The design allows the user a shower l4 that covers both front body and back of the body.

Figure 8:
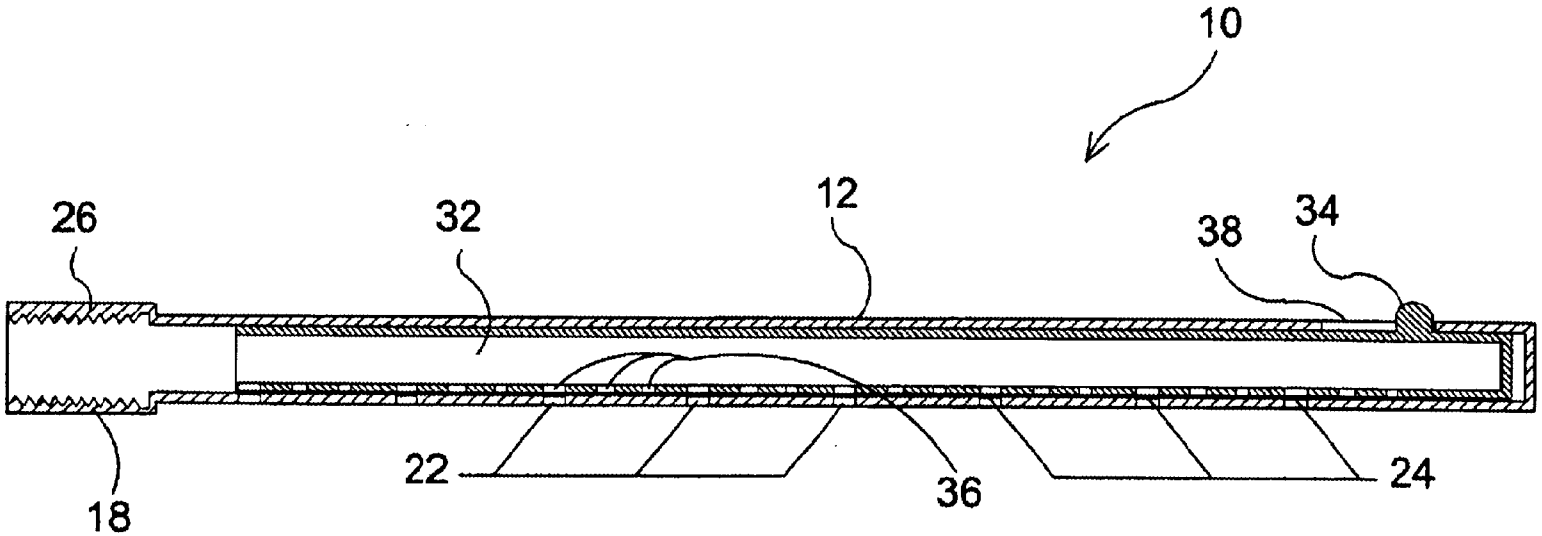
FIG. 8 is an alternate view of the present invention.

Turning to FIG. 8, shown therein is an alternate view of the present invention 10. Shown is an alternate view of the device of the present invention 10 having a tubular housing 12 including an inner adjustment tube member 32 that allows the user to adjust the spray from a fine spray to a heavy spray. The inner tube 32 has a plurality of shower outlet ports 36 therein and is adjusted to a predetermined position by sliding the adjustment member 34 into its selected position. Shower ports 36 of inner tube 32 are variously sized to vary the amount of water that pass therethrough. Ports 36 are spaced apart to align with outlet port 22 of the outer tube 12. The outlet ports 36 are spaced equally apart so that all ports 36 of the same size align simultaneously on a one-to-one basis with the outlet ports 22 so that the same size ports 36 are placed over ports 22 at any given time. Note that ports 22, 36 are disposed on the bottom side of the present invention 10, so as to spray downward on the user. A slot 38 is provided in the wall of housing 12 through which positioning member 34 passes so that a user can easily move member 34. The other previously disclosed elements are essentially the same as with the previously disclosed embodiment.

Figure 9:
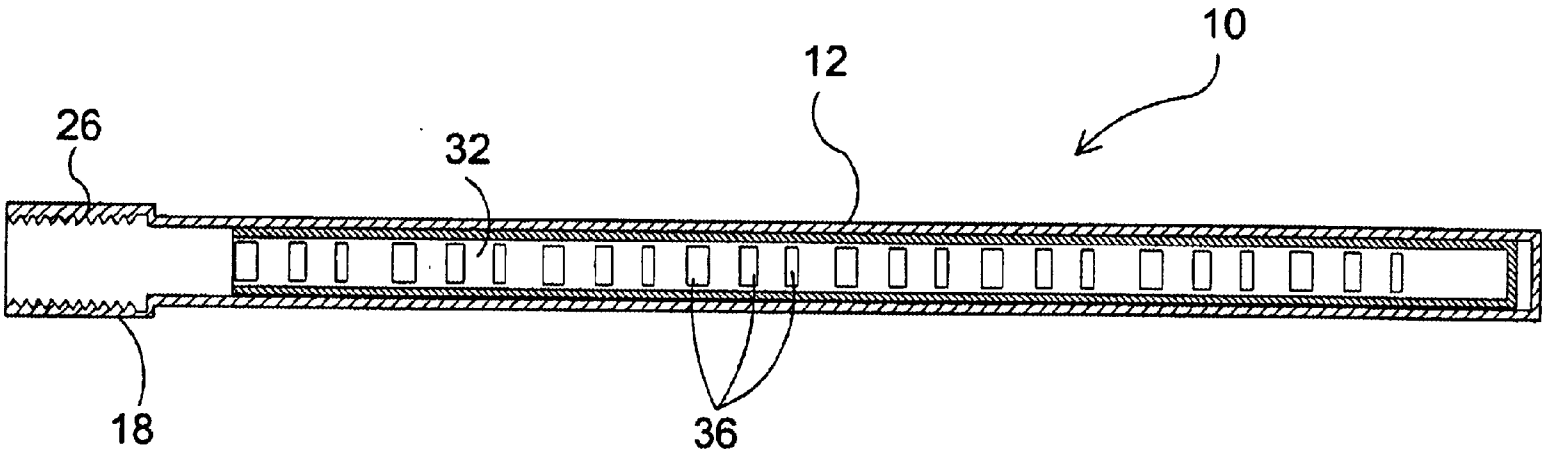
FIG. 9 is an alternate view of the present invention.

Turning to FIG. 9, shown therein is an alternate view of the present invention 10. Shown is an alternate view of the device of the present invention having a tubular housing 12 including an inner tube member 32 that allows the user to adjust the spray factor from a fine spray to a heavy spray using a plurality of variously sized outlets 36. The inner tube 32 is adjusted to a predetermined position by sliding the adjustment member into its respective position. Also shown are the connector 18 with its threads 26.

What is claimed to be new and desired to be protected by Letters Patent is set forth in the appended claims:

1. A shower head for attachment to a water outlet spout, said spout being a part of the plumbing system of a shower and having a threaded end thereon for receiving a mating shower head, the shower head comprising;

a) an elongated tubular housing for connection to said water outlet spout, said housing having a first end, a second end, a top side and a bottom side, said housing having an inner cavity therein for receiving an inner tubular member, said housing having a slot therein for receiving a positioning member;

b) a threaded connector disposed on said first end of said housing to permit connection to the threaded end of the water outlet spout, said second end of said housing being closed;

c) said housing having a plurality of water outlet holes therein, said holes being spaced apart longitudinally along said bottom side of said housing to permit water to pass downwardly therethrough onto a user;

d) a plurality of aerator screens, wherein one said screen is placed over each water outlet hole of said housing to permit the water to be sprayed over a user;

e) an elongated inner tubular member disposed in said inner cavity of said housing, said inner tubular member having first and second sets of water outlet holes spaced longitudinally along a bottom side of said inner tubular member and arranged in an alternating configuration, each one of said second set of water outlet holes being larger than each one of said first set of water outlet holes, said inner tubular member being slidable longitudinally within said housing and complementarily sized as said housing, said inner tubular member having a first end and a second end, said first end being open and said second end being closed; and f) a positioning member disposed on said inner tubular member, said positioning member passing through said slot of said housing to permit a user to grasp the positioning member for moving said inner tubular member between first and second longitudinal positions of adjustment relative to said housing for varying the flow of water through the shower head, said first set of water outlet holes being aligned with the water outlet holes of said housing when said inner tubular member is in the first longitudinal position of adjustment, and said second set of water outlet holes being aligned with the water outlet holes of said housing when said inner tubular member is in the second longitudinal position of adjustment.

2. The apparatus of claim 1, wherein said housing runs substantially horizontally over the shower, said housing having a length effective to apply water to the front and back of a human user simultaneously.

* * * * *